US009631897B1

(12) United States Patent
Irwin

(10) Patent No.: US 9,631,897 B1
(45) Date of Patent: Apr. 25, 2017

(54) DETACHABLE MOUNTING RAIL SYSTEM

(71) Applicant: Michael B. Irwin, Bagdad, KY (US)

(72) Inventor: Michael B. Irwin, Bagdad, KY (US)

( * ) Notice: Subject to any disclaimer, the term of this patent is extended or adjusted under 35 U.S.C. 154(b) by 0 days.

(21) Appl. No.: 14/678,693

(22) Filed: Apr. 3, 2015

Related U.S. Application Data

(60) Provisional application No. 61/974,734, filed on Apr. 3, 2014.

(51) Int. Cl.
*F41C 27/00* (2006.01)
*F41G 11/00* (2006.01)

(52) U.S. Cl.
CPC ..... *F41G 11/003* (2013.01)

(58) Field of Classification Search
CPC ..... F41G 11/003; F41C 23/16; F41C 23/22; F41A 3/22; F41A 3/30; F41A 15/12; F41A 15/14; F41A 19/30
USPC ..... 42/16, 25, 51, 69.02, 18, 90, 72, 71.01
See application file for complete search history.

(56) References Cited

U.S. PATENT DOCUMENTS 1,331,154 A 2/1920 Johnson
3,005,279 A 10/1961 Brewer
3,253,362 A 5/1966 Gitchell
4,653,210 A 3/1987 Poff
4,930,238 A 6/1990 Poff
5,109,622 A * 5/1992 Echeberria ..... F41A 17/46 42/51
5,259,137 A 11/1993 Blenk et al.
5,440,963 A * 8/1995 Szecsei ..... F41A 3/24 42/16
5,718,073 A 2/1998 Sachse et al.
6,189,253 B1 2/2001 Knight et al.
6,209,249 B1 4/2001 Borden
6,508,025 B1 1/2003 Du Plessis
7,823,317 B2 * 11/2010 Potterfield ..... F41A 23/16 248/121
8,381,629 B2 * 2/2013 Szecsei ..... F41A 3/24 42/16
8,695,985 B2 * 4/2014 Potterfield ..... F41J 1/10 248/156
9,015,982 B1 * 4/2015 Powers ..... F41G 1/44 42/119
2010/0175290 A1 7/2010 Du Plessis et al.
2013/0318852 A1 * 12/2013 Teetzel ..... F41C 27/00 42/90
2015/0192385 A1 * 7/2015 Krebs ..... F41C 23/16 42/71.01
2015/0253104 A1 * 9/2015 Holland ..... F41G 1/44 42/71.01
2015/0308790 A1 * 10/2015 Gravelle ..... F42B 39/00 42/90
2016/0084610 A1 * 3/2016 Wood ..... F41B 11/70 124/80
2016/0102939 A1 * 4/2016 Rice ..... F41C 27/16 42/71.01

(Continued)

*Primary Examiner* — Michael David
(74) *Attorney, Agent, or Firm* — Middleton Reutlinger; Alexander P. Brackett

(57) ABSTRACT

The present invention is a detachable rail assembly for mounting components to a firearm. The invention includes a rail body having forward and rear ends and a bottom surface having opposed angled dovetail surfaces. The rail body further includes forward and rear pockets having movable forward and rear clamping blocks secured therein for clamping the rail assembly to the firearm.

5 Claims, 8 Drawing Sheets

(56) References Cited

U.S. PATENT DOCUMENTS

| | | | | |
|---|---|---|---|---|
| 2016/0146558 | A1* | 5/2016 | Kada | F41A 3/56<br>42/16 |
| 2016/0153744 | A1* | 6/2016 | Teetzel | F41C 27/06<br>42/105 |

* cited by examiner

DETACHABLE MOUNTING RAIL SYSTEM

CROSS-REFERENCE TO RELATED APPLICATIONS

This application for patent claims the benefit of and priority to U.S. Provisional Patent Application No. 61/974,734 entitled "Detachable Mounting Rail System", filed on Apr. 3, 2014.

BACKGROUND OF THE INVENTION

The present invention relates generally to a scope and/or component mounting apparatus for a firearm, the apparatus being commonly referred to as a rail. More particularly, the invention relates to an improved rail assembly that provides the ability to rapidly remove and reinstall rails with a plurality of components and or sighting instruments pre-attached to the rail.

DESCRIPTION OF THE RELATED ART

A wide variety of rail systems have been developed in recent years to allow the secure fastening of optical sighting instruments to the barrel of a firearm as well as other assorted components such as laser sighting instruments, flashlights, and tactical handles to name just a few examples. Many rail systems may have a built in taper in relationship to the firearm barrel to facilitate sighting adjustments while firing at long range. Prior art rail attachment is typically accomplished by fastening the rail to the firearm with a series of small screws or fasteners. Alternately, some rails are manufactured as an integral part of the firearm.

These prior art integral rails are a permanent feature of the firearm whether or not they are being used. When not in use these systems add undesirable weight to the firearm, and expose the rail, which is typically a highly machined surface, to potential surface damage. Furthermore, where tapered rails are employed for long range shooting as a permanent feature of the firearm, they are typically a disadvantage for short range shooting.

Removable rails utilizing a series of screws to attach it to the firearm typically must first have the screws secured before a component can be added to the rail. Thus the component must be removed first before the rail can be removed or replaced with a different configured rail, creating a cumbersome process. Moreover, some shooters will very firmly attach sighting instruments to the rail for precise target shooting and will be disinclined to attempt the removal and disruption of the instrument in order for the rail to be replaced. In addition to creating an inconvenient process for rail replacement, shooters have at times deemed the small set of screws used to attach a rail to a firearm an inadequate means of securing the rail, allowing the rail and its attached instrument to be subject to shifting or disunion during hard use.

It has become accepted practice to secure assorted components via rails to tubes comprising the forend or forward shroud of a firearm barrel. To allow the attachment of components to the forend tube, rails are either integrally constructed with or fastened to the tube with screws or fasteners, both techniques creating the same disadvantages as mentioned herein above. Many forend tubes have openings cut through the tube wall to facilitate air movement and provide for cooling of the barrel. In addition to the undesirable extra weight and the potential of damaging the surfaces of the rail, the attachment of an unused rail will thus create another disadvantage by blocking the forend tube cooling openings and thereby preventing the desired circulation of cooling air for barrel cooling.

Accordingly, a need exists to secure a rail to a firearm eliminating the aforementioned problems by providing a rapid and repeatable means for removal and reinstallation of a rail without disruption of a component attached to the rail, while also providing a very rigid means of securing the rail to the firearm.

BRIEF DESCRIPTION OF THE DRAWING FIGURES

DETAILED DESCRIPTION OF THE PREFERRED EMBODIMENT(S)

Figure 1:
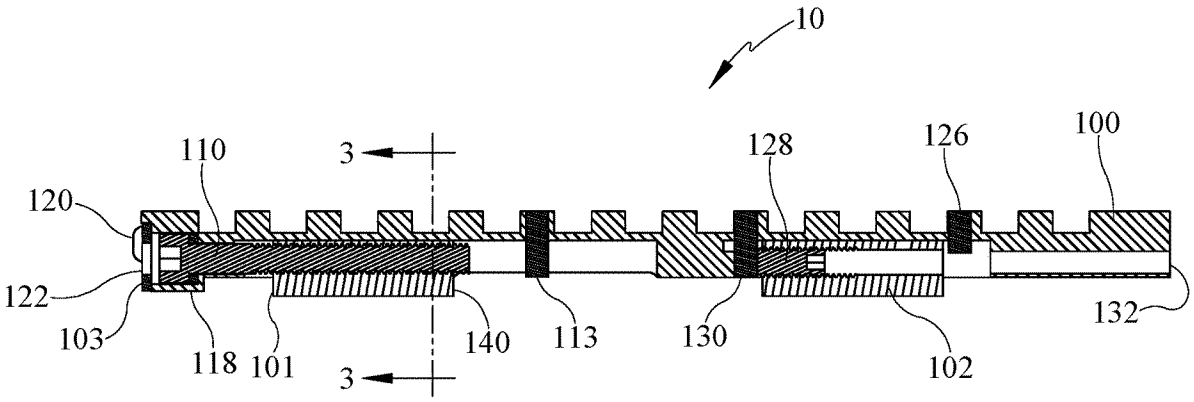
FIG. 1 is a cross-sectional view of a detachable rail assembly in accordance with one embodiment of the present invention.
Figure 2:
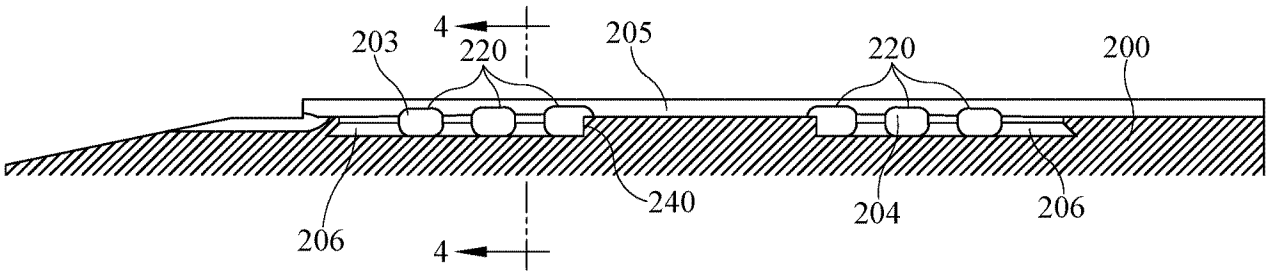
FIG. 2 is a cross-sectional view of the top portion of a receiver in accordance with one embodiment of the present invention.
Figure 3:
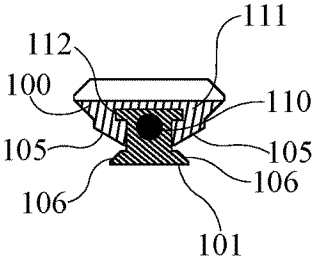
FIG. 3 is a cross-sectional view of a detachable rail assembly taken along the line 3-3 of FIG. 1 in accordance with one embodiment of the present invention.
Figure 4:
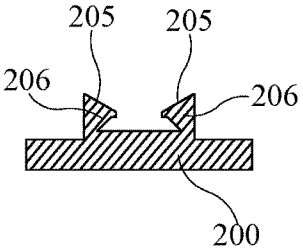
FIG. 4 is a cross-sectional view of the top portion of a receiver taken along the line 4-4 of FIG. 2 in accordance with one embodiment of the present invention.

Referring now to FIGS. 1-4, and 20-25, and in accordance with one embodiment of the present invention a novel detachable rail assembly 10 is shown, intended to be mounted or secured to a firearm receiver 200 which is depicted in part in FIGS. 1, 2 and 4. The lower portion of receiver 200 is not shown for purposes of clarity. Detachable rail assembly 10 comprises a detachable rail body 100 with configured to allow the mounting of sighting instruments such as scopes, laser sights, or lights (not shown), and a rear clamping block 101 actuated by a clamping screw 110. Rear clamping block 101 is enclosed in rail body 100 forward of a containment plate 103 that prohibits block 101 from being separated from rail body 100. Rail assembly 10 also comprises a forward clamping block 102. Rear clamping block 101, screw 110 and containment plate 103 are adapted to be received and movably secured within detachable rail body 100 via a plurality of conventional helical threads 107, for example.

A conventional firearm receiver 200 typically includes a rear receptacle 203 to receive rear clamping block 101 and a forward receptacle 204 to receive forward clamping block 102. Receiver 200 may also include mounting surfaces 205 as seen in FIGS. 2 and 4. Longitudinally oriented mounting surfaces 205 are shaped to engage corresponding mounting surfaces 105 arranged along detachable rail body 100, as best seen in FIG. 3.

Additionally, firearm receiver 200 may include a plurality of angled dovetail surfaces 206 that are oriented to receive complementary angled dovetail surfaces 106 of clamping blocks 101 and 102. A plurality of dovetail surfaces may be positioned longitudinally along clamping blocks 101, 102 as best seen in, for example, FIG. 25. Receiver 200 rear receptacle 203 and forward receptacle 204 respectively include clearance areas or voids 220 that permit the insertion and engagement of angled male dovetail surfaces 106, as best seen in FIGS. 20-25.

Referring now to FIGS. 8-11, 18, 28, and 29 and in accordance with one embodiment of the present invention a detachable rail assembly 30 is shown, intended to be mounted into a firearm forend tube 400. Detachable rail assembly 30 comprises a detachable longitudinal rail body 300 with top surfaces 307 shaped to allow the mounting of assorted components (not shown). Rail body 300 further comprises two clamping blocks 301 and 302 respectively, actuated by two clamping screws 310 which are in turn secured to rail body 300 by two containment plates 303. Clamping blocks 301, 302, screws 310, and containment plates 303 are each adapted to be received and contained within detachable rail body 300 in symmetrical fashion, as discussed further herein below.

Figure 10:
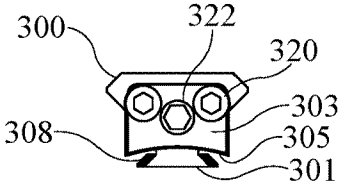
FIG. 10 is an end view of a detachable rail assembly taken along line 10-10 of FIG. 8 in accordance with one embodiment of the present invention.
Figure 11:
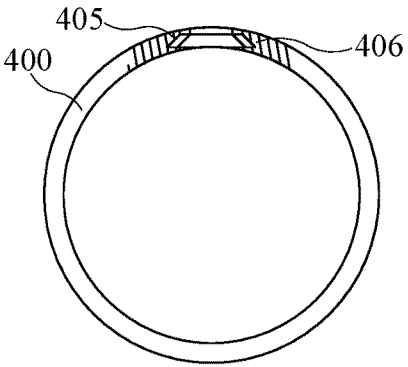
FIG. 11 is a partial cross-sectional view of a firearm forend tube taken along the line 11-11 of FIG. 9 in accordance with one embodiment of the present invention.
Figure 18:
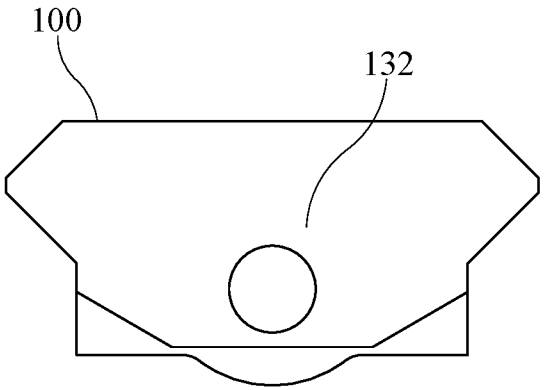
FIG. 18 is an end view of a detachable rail assembly taken along line 18-18 of FIG. 14 in accordance with one embodiment of the present invention.
Figure 17:
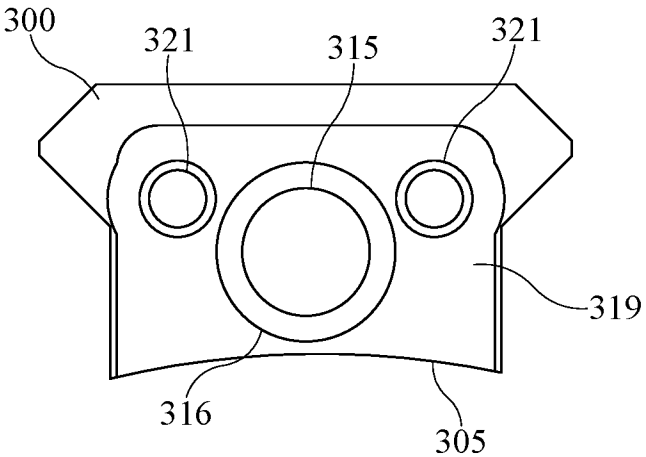
FIG. 17 is an end view of a detachable rail assembly taken along line 17-17 of FIG. 16 in accordance with one embodiment of the present invention.

Receiver forend tube 400 may include a plurality of forward apertures 403 and rear apertures 404 in multiple and numerous locations extending through the walls of forend tube 400 to allow air movement when not in use for cooling of a firearm barrel (not shown) secured inside said forend tube 400. Apertures 403 and 404 may also receive clamping blocks 301 and 302, with either end of detachable rail body 300 capable of being oriented in a forward direction, or toward the muzzle-end of the firearm. Forend tube 400 may further include a rounded surface 405 as best seen in FIG. 11, the radius of said surface 405 being continuous throughout the outer circumference of forend tube 400. Rounded surface 405 has a radius that is sized to match and to receive a rounded bottom mounting surface 305 of detachable rail body 300, as best seen in FIGS. 10 and 18. Rounded mounting surface 305 may have an identical radius to that of mating rounded surface 405 for ease of assembly.

Figure 9:
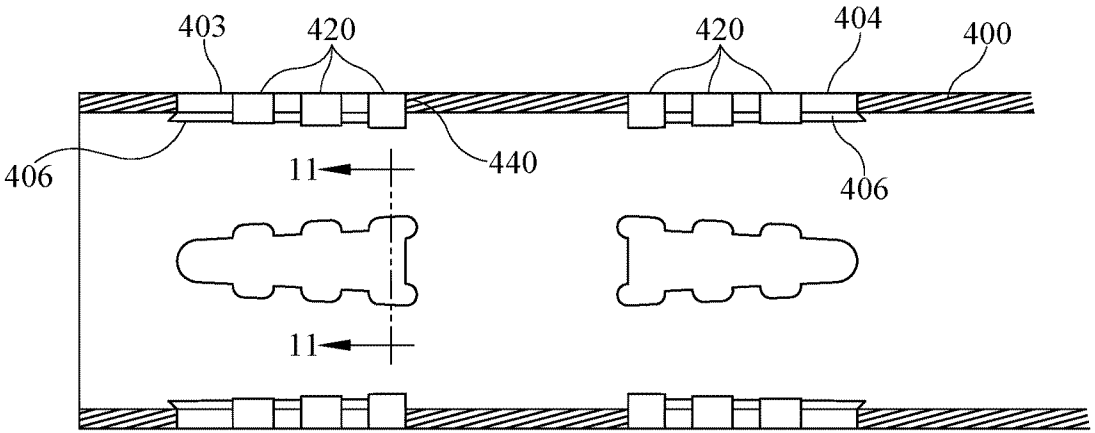
FIG. 9 is a cross-sectional view of a firearm forend tube in accordance with one embodiment of the present invention.

Forend tube 400 may further include a plurality of angled dovetail surfaces 406, as seen in FIGS. 9, 10 and 11, to receive concomitant angled dovetail surfaces 306 arranged along detachable rail body 300. Forward receptacle 403 and rear receptacle 404 respectively may also comprise clearance areas or voids 420 to allow insertion and engagement of angled dovetail surfaces 306, as best seen in FIGS. 28 and 29.

Figure 27:
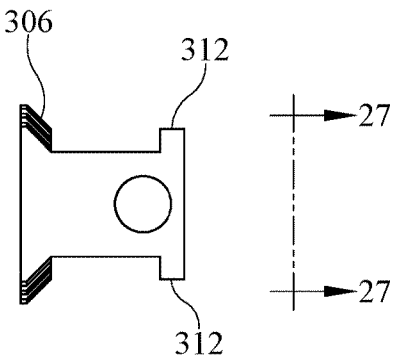
FIG. 27 is an end view of a clamping block in a rearward position taken along the line 27-27 of FIG. 26 in accordance with one embodiment of the present invention.
Figure 28:
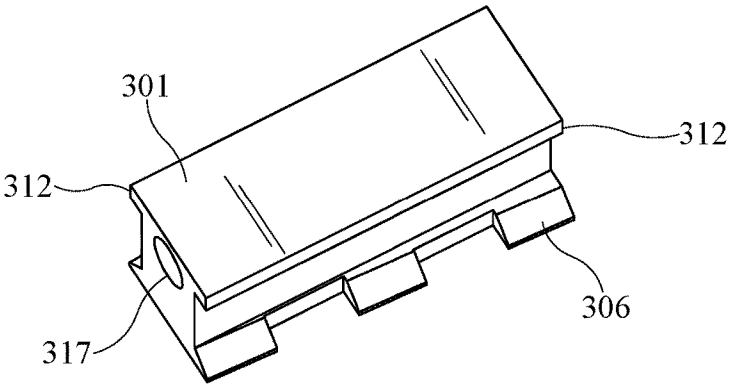
FIG. 28 is an isometric view of a clamping block in a forward position in accordance with one embodiment of the present invention.

Referring now to drawing FIGS. 8, 10, 17, and 26-29 detachable rail body 300 may further include a centrally located pocket 304 and front and rear slots 311 to facilitate installation of clamping blocks 301 and 302. Front and rear slots 311 both extend outwardly away from central pocket 304 to receive and engage top surfaces 312 of clamping blocks 301 and 302, as best seen in FIGS. 27-29. Once clamping blocks 301 and 302 are inserted and top surfaces 312 are engaged by front and rear slots 311, first and second dowel pins 313 are installed and held by a press fit into apertures 314 of detachable rail body 300, thereby preventing clamping blocks 301 and 302 from sliding into central pocket 304 of rail body 300.

Figure 8:
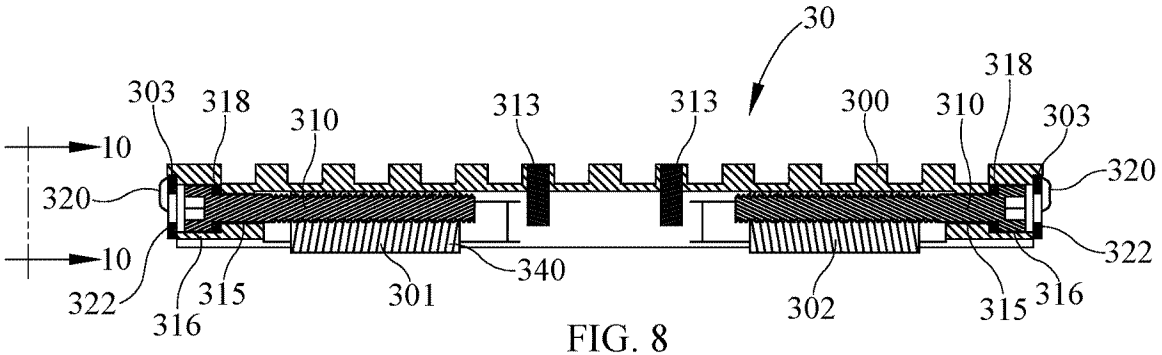
FIG. 8 is a cross-sectional view of a detachable rail assembly in accordance with one embodiment of the present invention.

Detachable rail body 300 may further include two apertures 315 and concomitant counter bores 316 as seen in FIG. 8 and in FIG. 18. Apertures 315 and counter bores 316 accept clamping screws 310. Clamping screw 310 also engages threaded apertures 317 of each clamping block 301 and 302, at each end respectively, thereby allowing engagement of said clamping blocks 301 and 302 by clamping screws 310 at either end of said detachable rail body 300. The surface of detachable rail body 300 located at the bottom of each counter bore 316 is protected from damage caused by the engagement of rear clamping screws 310 by lock washers 318 as seen in FIG. 8.

Detachable rail body 300 further includes complementary surfaces 319, best seen in FIG. 18, at each end of detachable rail body 300 to receive containment plates 303, secured in place by button head screws 320 via threaded apertures 321 as seen in FIGS. 8 and 18, at each end of detachable rail body 300 respectively. Containment plates 303 prevent clamping blocks 301, 302 from sliding out of rail body 300.

Access to clamping screws 310 to engage clamping block 301 or clamping block 302 is available through apertures 322 in each containment plate 303 as seen in FIG. 8.

Referring now to drawing FIGS. 1, 3, 15, 16, and 20-22 detachable rail body 100 may include a rear pocket 104 for installation of rear clamping block 101, and a rear t-slot 111 longitudinally disposed in rail body 100. Once rear clamping block 101 is inserted into rear pocket 104 and its top surface 112 is engaged by t-slot 111, rear dowel pin 113 is installed and held by a press fit in aperture 114 of detachable rail body 100, thereby prohibiting rear clamping block 101 from moving back into rear pocket 104.

Figure 16:
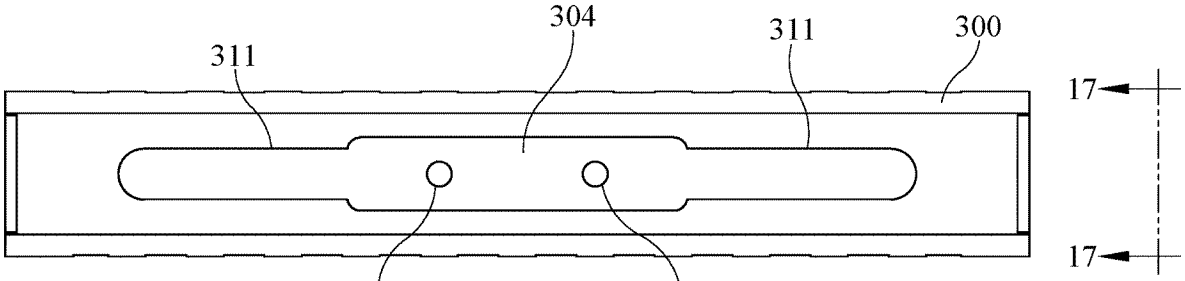
FIG. 16 is a bottom view of a detachable rail assembly in accordance with one embodiment of the present invention.

Detachable rail body 100 further includes aperture 115 and counter bore 116 as seen in FIG. 16 to receive clamping screw 110. Clamping screw 110 includes helical threads that engage an aperture 117 of rear clamping block 101, thereby securing rear camping block 101 in rail body 100. The surface of detachable rail body 100 located at the bottom of counter bore 116 is protected from damage caused by the engagement of rear clamping screw 110 by a lock washer 118 as seen in FIG. 1.

Detachable rail body 100 may further include a complementary surface 119 to receive a containment plate 103, secured in place to rail body 100 by two button head screws 120 via threaded apertures 121 as seen in FIGS. 1 and 16. Access to clamping screw 110 to actuate or engage clamping block 101 is available through aperture 122 of said containment plate 103 as seen in FIG. 1.

Referring now to drawing FIGS. 1, 3, 15, 19, and 23-25 detachable rail body 100 may additionally include a forward pocket or void 124 with six interrupted clearance areas 123 to receive six complementary top surfaces 125 of forward clamping block 102. Forward clamping block 102 is thus inserted into detachable rail body 100 via clearance areas 123 slid rearwardly with surfaces 112 of rail body 100 engaging top surfaces 125 of clamping block 102. A front dowel pin 126 which is installed and held by press fit in an aperture 127 of detachable rail body 100 will operate to inhibit forward movement of forward clamping block 102 into clearance area 123, once clamping block 102 is properly installed.

Figure 19:
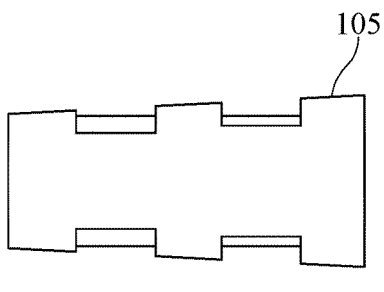
FIG. 19 is a bottom view of a rear clamping block in accordance with one embodiment of the present invention.
Figure 20:
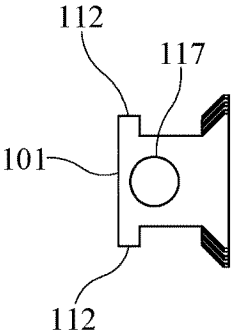
FIG. 20 is an end view of a rear clamping block taken along line 20-20 of FIG. 19 in accordance with one embodiment of the present invention.
Figure 24:
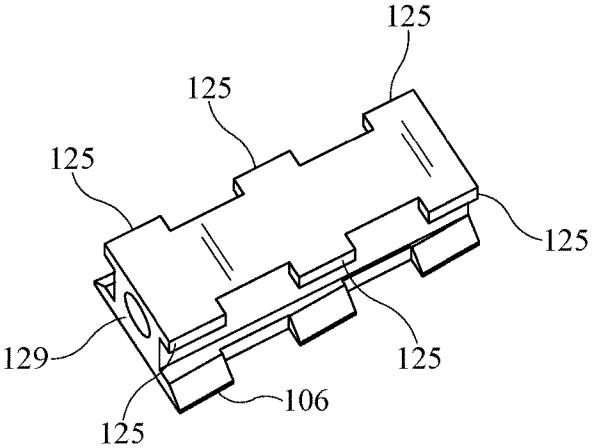
FIG. 24 is an isometric view of a forward clamping block in accordance with one embodiment of the present invention.
Figure 25:
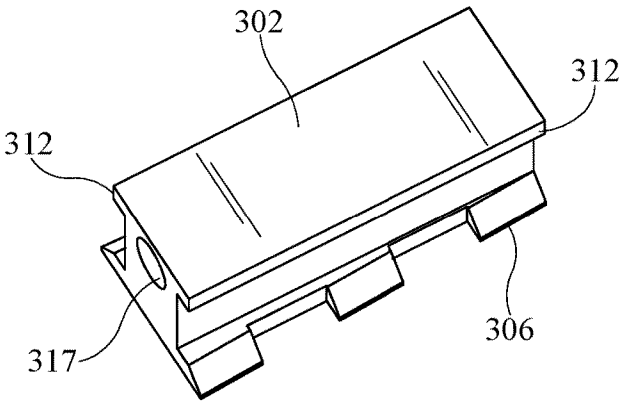
FIG. 25 is an isometric view of a clamping block in accordance with one embodiment of the present invention.
Figure 26:
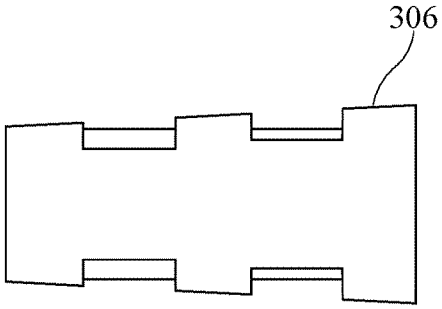
FIG. 26 is a bottom view of a clamping block in accordance with one embodiment of the present invention.

To allow linear adjustability, forward clamping block 102 further comprises a set screw 128 having helical threads thereon, as seen in FIG. 1, received by threaded aperture 129 disposed in forward clamping block 102, as best seen in FIGS. 24 and 25. Set screw 128 engages a dowel pin 130 that is installed and held by a press fit in aperture 131 of detachable rail body 100. Access to set screw 128 to allow adjustments to the linear location of forward clamping block 102 is available through an access aperture 132 at the front of detachable rail body 100, as seen in FIG. 1 and FIG. 19.

Figure 5:
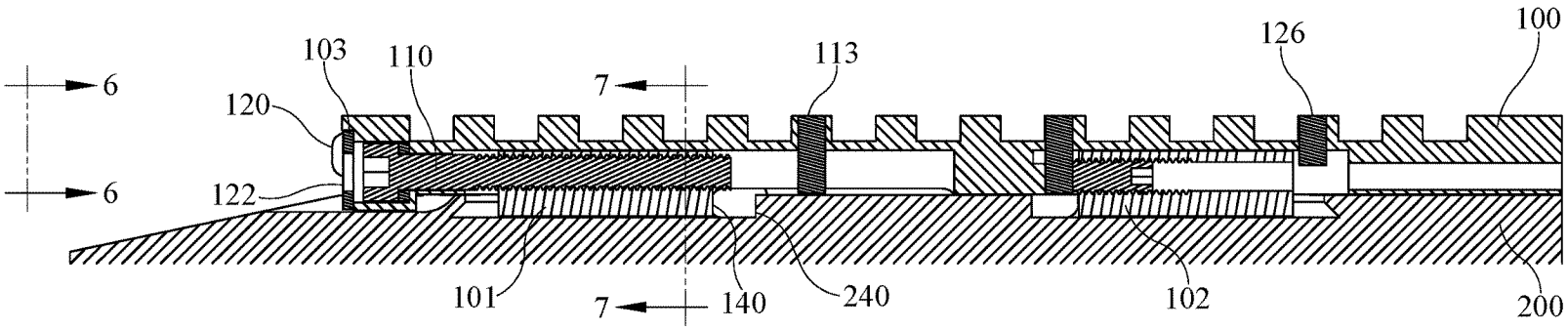
FIG. 5 is a cross-sectional view of a detachable rail assembly and a firearm receiver in in accordance with one embodiment of the present invention.
Figure 22:
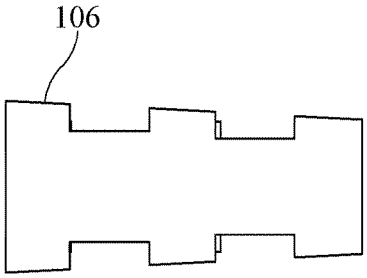
FIG. 22 is a bottom view of a forward clamping block in accordance with one embodiment of the present invention.
Figure 23:
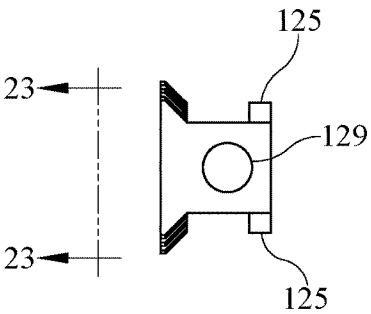
FIG. 23 is an end view of a forward clamping block taken along line 23-23 of FIG. 22 in accordance with one embodiment of the present invention.
Figure 21:
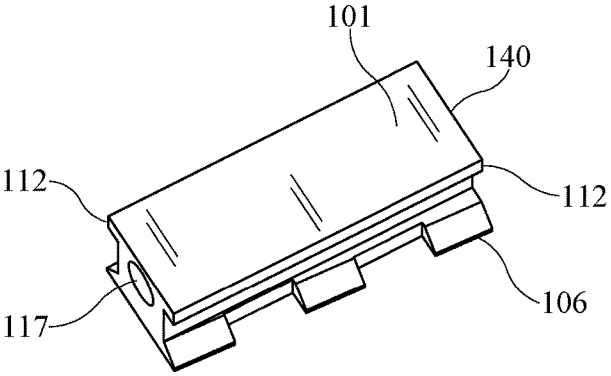
FIG. 21 is an isometric view of a rear clamping block in accordance with one embodiment of the present invention.

Referring now to drawing FIGS. 1-7, and 20-25 detachable rail assembly 10, detachable rail body 100, rear clamping block 101, and forward clamping block 102 are depicted being installed into receiver 200, as best seen in FIG. 5. An allen wrench tool (not shown) inserted through aperture 122 of containment plate 103 allows clockwise rotation of clamping screw 110, thereby pulling clamping block 101 rearward. As rear clamping block 101 travels rearward, angled dovetail surfaces 106 of said rear clamping block 101 contact mating angled dovetail surfaces 206 of receiver 200. Both angled dovetail surfaces 106, as best seen in FIG. 22, and angled dovetail surfaces 206 are the same included angle, gradually decreasing in width as they approach the rear of rail assembly 10 and receiver 200 respectively.

Figure 7:
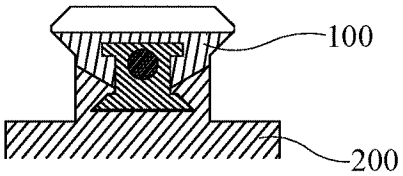
FIG. 7 is a cross-sectional view a detachable rail assembly and a firearm receiver taken along the line 7-7 of FIG. 5 in accordance with one embodiment of the present invention.
Figure 6:
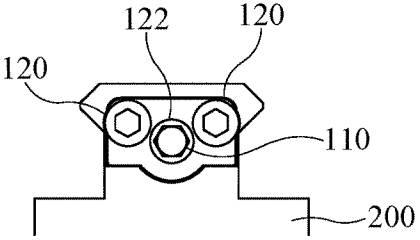
FIG. 6 is an end view of a detachable rail assembly and a firearm receiver taken along line 6-6 of FIG. 5 in accordance with one embodiment of the present invention.

After rearward movement of rear clamping block 101 is halted by the engagement of angled dovetail surfaces 106 and angled dovetail surfaces 206, continued rearward actuation (rotation) of clamping screw 110 will then begin to move detachable rail body 100 forward as will the forward clamping block 102 secured to detachable rail body 100. Forward movement of forward clamping block 102 will provide the same joining of angled dovetail surfaces 106 present on said forward clamping block 102 as seen in FIG. 25 and angled dovetail surfaces 206 of receiver 200 as previously described. Once both rear and forward angled dovetail surfaces 106, 206 are securely engaged, continued actuation (rotation) of clamping screw 110 will engage male mounting surface 105 of detachable rail body 100 to female mounting surface 205 of receiver 200 to firmly secure rail body 100 to receiver 200. The angled mating surfaces 106, 206 disposed along the full length of both the rail body 100 and receiver 200 as best seen in FIG. 7 will allow both rigidity in union and repeatability of location upon removal and reinstallation of rail assembly 10.

Detachment of rail assembly 10 from receiver 200 is provided by the counter-clockwise rotation of clamping screw 110. With the rear clamping block 101 secured in place, counter-clockwise rotation of clamping screw 110 will move clamping screw 110 slightly rearward until it is stopped by containment plate 103. Rear clamping block 101 will then begin to move forward out of a clamped position by the continued actuation (rotation) of clamping screw 110. The forward movement of rear clamping block 101 will eventually be stopped by the front surface 140 of rear clamping block 101 contacting surface 240, located inside and to the front of rear aperture 203 of receiver 200.

Upon stopping the forward movement of rear clamping block 101, continued counter-clockwise actuation of clamping screw 110 will then begin to move detachable rail body 100 rearward. Once front dowel pin 126 of detachable rail body 100 contacts the front surface of forward clamping block 102, forward clamping block 102 will begin to move rearward out of a clamped position. Finally, once rear dowel pin 113 contacts front surface 140 of rear clamping block 101, counter clockwise actuation of clamping screw 110 will be complete. In this position, dovetail surfaces 106 will align with clearance areas 220 of receiver 200 and thereby allow removal of detachable rail assembly 10 from receiver 200.

Modular in design, detachable rail assembly 10 can be sized and configured as necessary to provide extended length out and above a firearm barrel, extra height, integral rings, customized top or mounting surfaces allowing the mounting of complementary sighting instruments angled downward in relationship to the barrel, or top surfaces canted in relationship to the barrel; all readily and quickly secured to receiver 200 as described herein by operation of invention 10. Furthermore, mating surfaces of receiver 200 can be integral or as a separate base attached to a receiver, with mating surfaces manufactured into the base to accept the attachment of the rail assembly described herein.

Referring once again to drawing FIGS. 8-13 and 26-29, either end of detachable rail assembly 30 can face the front of forend tube 400. Furthermore, once detachable rail assembly 30 is received by forend tube 400, either clamping block 301 or 302 can be actuated from either end of said detachable rail assembly 30. For clarity of explication only, clamping block 301 will serve as the actuating block, while clamping block 302 serves in a fixed position, necessarily located slightly farther from central pocket 304 than clamping block 301 to allow correct movement of clamping block 301 prior to forend tube 400 receiving detachable rail assembly 30.

Figure 12:
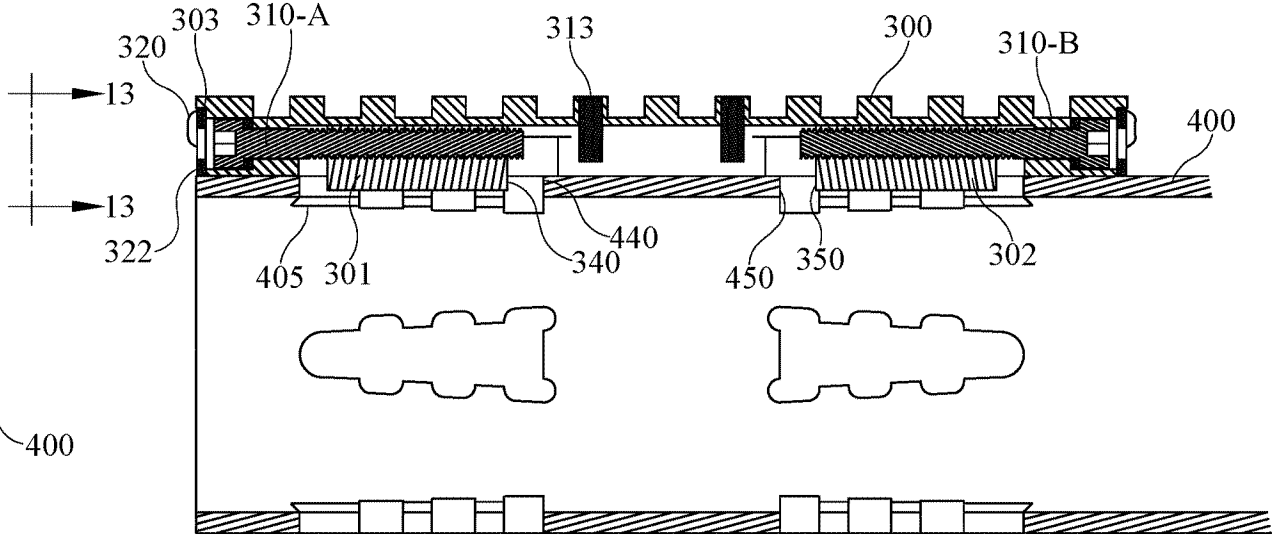
FIG. 12 is a cross-sectional view of a detachable rail assembly and a firearm forend tube in accordance with one embodiment of the present invention.

Detachable rail assembly 30, detachable rail body 300, clamping block 301, and clamping block 302 are received by forend tube 400 as seen in FIG. 12. An allen wrench tool (not shown) inserted through aperture 322 of containment plate 303 allows clockwise rotation of clamping screw 310A, thereby pulling clamping block 301 forward away from central pocket 304. As clamping block 301 travels forward and away from central pocket 304, angled dovetail surfaces 306 of clamping block 301 contact mating angled dovetail surfaces 406 of forend tube 400. Both angled dovetail surfaces 306, as best seen in FIGS. 28 and 29, and angled dovetail surfaces 406 are the same included angle, decreasing in width from one end to another, to provide a clamping force as surfaces 306, 406 engage each other.

Figure 13:
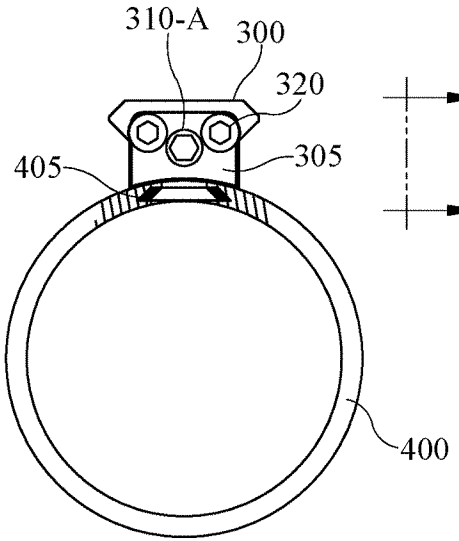
FIG. 13 is an end view of a detachable rail assembly taken along line 13-13 of FIG. 12 in accordance with one embodiment of the present invention.
Figure 15:
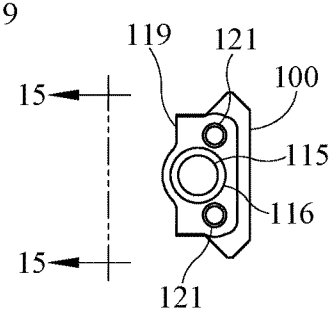
FIG. 15 is an end view of a detachable rail assembly taken along line 15-15 of FIG. 14 in accordance with one embodiment of the present invention.
Figure 14:
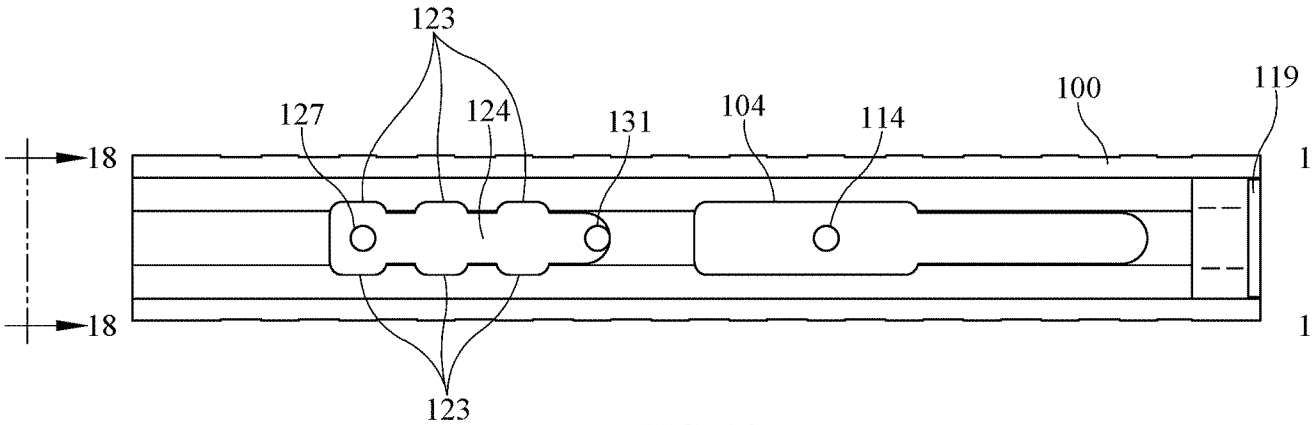
FIG. 14 is a bottom view of a detachable rail body in accordance with one embodiment of the present invention.

After movement of clamping block 301 is halted by the joining of angled dovetail surfaces 306 to angled dovetail surfaces 406, continued actuation of clamping screw 310A will begin to move detachable rail body 300 and clamping block 302 rearward, away from the front of forend tube 400. Clamping block 302 is held in a static position inside detachable rail body 300 by second clamping screw 310B, allowing it to move rearward with detachable rail body 300. This rearward movement of clamping block 302 will then allow the same joining of angled dovetail surfaces present on said clamping block 302 and forend tube 400 as previously described. Once both angled dovetail surfaces 306 of clamping block 301 and clamping block 302 are joined with dovetail surfaces 406 of forend tube 400, continued actuation of clamping screw 310A will mate bottom mounting surface 305 of detachable rail body 300 to round surface 405 of forend tube 400 in a very firm and rigid seat. The mating surfaces disposed along the rail base bottom on the forend tube as best seen in FIG. 13 will allow rigidity in union even after removal and reinstallation of rail assembly 30.

To remove detachable rail assembly 30 from forend tube 400, either clamping block 301 or 302 can be actuated from either end of said detachable rail assembly 30. Therefore, for clarity of explanation provided here, removal of rail assembly 30 from forend tube 400 is provided by the counter clockwise rotation of clamping screw 310A. With the clamping block 301 clamped in place, counter clockwise rotation of clamping screw 310A will move clamping screw 310A slightly forward until it is stopped by containment plate 303 which is secured in place by two button head screws 320. Rear clamping block 301 will then begin to move rearward out of a clamped position by the continued actuation of clamping screw 310A. The rearward movement of the clamping block 301 will be discontinued by surface 340 of said clamping block 301 contacting surface 440, located inside receptacle 403 of forend tube 400. Upon stopping the forward movement of clamping block 301, continued counter-clockwise actuation of clamping screw 310A will then begin to move detachable rail body 300 forward, towards the front of forend tube 400. Clamping block 302 is held in a static position inside detachable rail body 300 by second clamping screw 310B, allowing it to move forward out of a clamped position with detachable rail body 300. Finally, cone dowel pin 313 contacts surface 340 of clamping block 301, counter-clockwise actuation of clamping screw 310A will be complete. In this position, tapered dovetail surfaces 306 will be aligned with clearance areas 420 of forend tube 400 and thereby allow removal of detachable rail assembly 30 from forend tube 400.

Symmetrical and modular in design, detachable rail assembly 30 can be attached and detached form forend tube 400 by actuating clamping screw 310B of the rear end of rail body 300 versus the forward end described above. The operation of the components described herein above will occur in a mirror image fashion, and in the procedure of detachment, and best seen in FIG. 12, surface 350 of detachable rail body 300 will act on surface 450 located in pocket 404 of forend tube 400 to unclamp (or unbind) clamping block 301, held static to detachable rail body 300 by clamping screw 310A. Clamping screw 310A and 310B can be adjusted complementarily to each other to clamp rail assembly 30 at a desired linear location along forend tube 400.

Furthermore, while forend tube as described herein has been a single continuous outside round surface, one of ordinary skill in the art will realize that forend tubes can also be of arbitrary shape, utilizing angled surfaces or flats at different locations to subsequently mate and compliment bottom surfaces of rail assemblies for attachment.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A rail assembly for mounting components to a firearm, said rail assembly being mounted to a forend tube of said firearm, said forend tube having angled mating surfaces thereon, said rail assembly comprising:

a rail body having forward and rear ends and a bottom surface having opposed angled dovetail surfaces therein, said rear end of said body having a rear pocket having a t-slot therein, and said forward end of said body having a forward pocket with an interrupted t-slot therein, each of said forward and rear pockets further having movable forward and rear clamping blocks secured therein respectively, said clamping blocks engaging said t-slots; and a threaded rear aperture disposed in said rear pocket for accepting a helical screw therein, whereby said helical screw engages said rear clamping block in said rear pocket thereby moving said rear clamping block linearly forward.

2. The rail assembly of claim 1 comprising:

at least one dowel pin secured through an aperture in said rail body, said forward clamping block in said forward pocket abutting said at least one dowel pin to prevent rear motion thereof.

3. The rail assembly of claim 1 comprising:

a threaded aperture in said forward clamping block for receiving a threaded set screw whereby rotation of said set screw forces said forward clamping block linearly forward away from said at least one dowel pin.

4. The rail assembly of claim 1 comprising:

a plurality of upper surfaces disposed on said rail body for mounting components thereon.

5. The rail assembly of claim 1 comprising:

a containment plate secured to said rail body and enclosing the rear pocket thereof, said containment plate retaining said rear clamping block within said rear pocket.

* * * * *